US007527696B1

(12) United States Patent
Aus

(10) Patent No.: US 7,527,696 B1
(45) Date of Patent: May 5, 2009

(54) DEBRIS REMOVAL TOOL AND METHOD

(75) Inventor: Alvin A. Aus, Grand Island, NE (US)

(73) Assignee: CMK Engineering Inc., Grand Island, NE (US)

( * ) Notice: Subject to any disclaimer, the term of this patent is extended or adjusted under 35 U.S.C. 154(b) by 0 days.

(21) Appl. No.: 11/333,625

(22) Filed: Jan. 17, 2006

(51) Int. Cl.
*B08B 1/00* (2006.01)

(52) U.S. Cl. ..... 134/6; 134/42; 15/23; 15/50.1; 15/93.1; 15/236.1; 299/39.9; 299/40.1; 30/169; 30/276; 407/33; 407/34; 407/35; 407/40; 407/41; 407/43; 407/46; 407/47; 407/48; 407/49; 407/51; 407/52; 407/56; 407/61; 407/119; 144/252.1; 144/252.2

(58) Field of Classification Search ..... 134/6, 134/42; 15/23, 50.1, 93.1, 236.1; 299/39.9, 299/40.1; 30/169, 276; 407/33, 34, 35, 40, 407/41, 43, 46–49, 51–52, 56, 61, 119; 144/252.1, 144/252.2
See application file for complete search history.

(56) References Cited

U.S. PATENT DOCUMENTS 3,662,424 A * 5/1972 Whitsett ..... 15/236.1
4,041,565 A * 8/1977 Hatley ..... 15/200
4,148,110 A * 4/1979 Moen ..... 15/385
5,980,371 A * 11/1999 McConnell ..... 451/352

* cited by examiner

*Primary Examiner*—Sharidan Carrillo
(74) *Attorney, Agent, or Firm*—Holland & Hart, LLP

(57) ABSTRACT

A debris removal tool is generally provided with a head unit having a base plate, at least one cutting tooth and a drive unit for rotating the base plate. A flex plate may be provided for biasing the base plate with respect to an axis of rotation. The cutting teeth may be removably and pivotably coupled with the base plate. An elongated handle may be provided for use with the head unit and may be pivotably secured there too. Rechargeable and disposable power sources may be used with the drive unit. Various embodiments that incorporate functional grips and brushes are also disclosed.

11 Claims, 7 Drawing Sheets

DEBRIS REMOVAL TOOL AND METHOD

Your Petitioner, ALVIN A. AUS, a citizen of the United States and a resident of the State of Nebraska, whose post office address is 839 E. Phoenix Avue. Grand Island, Nebr. 68801, prays that Letters Patent may be granted to him for the invention set forth in the following specification.

BACKGROUND

Unwanted debris of various forms collects on operating surfaces found in everyday life. From ice and snow that accumulates on the windshields of automobiles, to barnacles that attach to the exterior surface of boats and ships, surface debris has become ubiquitous. The age old method of removing debris from nearly any operating surface involves the manual engagement of a scraping blade across the debris laden operating surface. Unfortunately, as many cold weather climatic residents will attest during the winter months, manual scraping of ice covered windshields and windows can be a time consuming and strenuous task. Moreover, where the scraping is performed during adverse weather conditions, each additional moment spent exposed to the weather only creates additional discomfort for the operator.

To further compound the problem, not every operating surface that collects debris is perfectly flat. To be sure, most windshields and ship hulls provide a slightly curved surface. Accordingly, where scraping tools are employed, which are incapable of adjusting to the planar changes of a curved surface, any scraping effort employed is inefficient at best. Even where a scraping tool is provided with a large, broad scraping edge, the tool can only remove a limited area of debris with each pass, based upon the level of curvature exhibited by the operating surface.

Accordingly, what is needed is a novel debris removal tool and method of using the same. Such a tool should employ a powered drive unit and be able to accommodate curved surfaces, quickly and easily. However, such a tool must remain simple in manufacture and use.

SUMMARY OF THE INVENTION

This Summary is provided to introduce a selection of concepts in a simplified form that are further described below in the Detailed Description. This Summary is not intended to identify key features or essential features of the claimed subject matter. Moreover, this Summary is not intended for use as an aid in determining the scope of the claimed subject matter.

A method of removing debris from an operating surface is disclosed that incorporates the use of a debris removal tool. The tool is generally comprised of a head unit, having a base plate and at least one cutting tooth that extends outwardly from a lower surface of the base plate and a drive unit, which is operatively coupled with the base plate in a manner that permits the drive unit to selectively rotate the base plate about an axis extending generally normal to the base plate. In use, the debris removal tool is positioned closely adjacent the operating surface. The drive unit then actuated so that the base plate begins rotating. The operator may then simply move the debris removal tool adjacent the operating surface so that the cutting tooth engages the debris, as the base plate and cutting tooth rotate, removing the debris from the operating surface.

In a preferred embodiment, a flex plate is operatively coupled with the base plate and the drive unit such that the axis on which the base plate rotates is permitted to swivel with respect to the drive unit. In order to further accommodate the changing pitch of an operating surface, the debris removal tool may be provided with an elongated handle, which may be placed in fixed or pivotable connection with the head unit.

In another preferred embodiment, cutting teeth may be removably coupled with the base plate in order to facilitate repair and modifications to the tool. The teeth may also be placed in pivoting engagement with the base plate in order to help the tool accommodate operating surfaces of variable geometry. Various power sources, including rechargeable and disposable batteries are contemplated.

It is therefore a principal object of the present invention to provide a debris removal tool and method that employ the use of a rotating cutting head.

A further object of the present invention is to provide a debris removal tool and method that employ a rotating cutting head that is selectively biasable from an axis on which the cutting head rotates.

Still another object of the present invention is to provide a debris removal tool having one or more removable cutting teeth.

Yet another object of the present invention is to provide a debris removal tool and method that incorporate the use of one or more pivoting cutting teeth.

A further object of the present invention is to provide a debris removal tool and method that employ an elongated handle for pivotably supporting a rotating cutting head.

Still another object of the present invention is to provide a powered debris removal tool and method that employ rechargeable or disposable power sources.

Yet another object of the present invention is to provide a debris removal tool and method that are relatively simple to manufacture and use.

These and other objects of the present invention will be apparent after consideration of the Detailed Description and Figures herein.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

Figure 1:
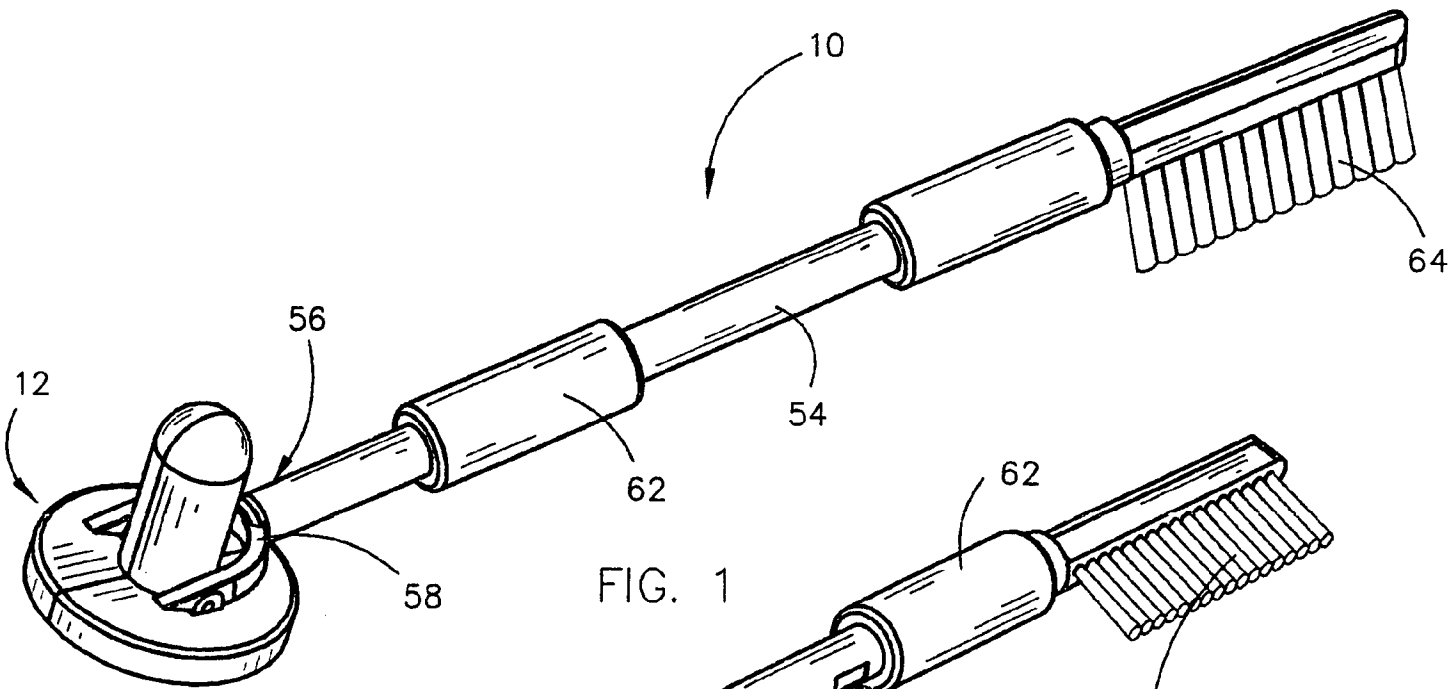
FIG. 1 depicts a perspective view of one embodiment of the debris removal tool.
Figure 2:
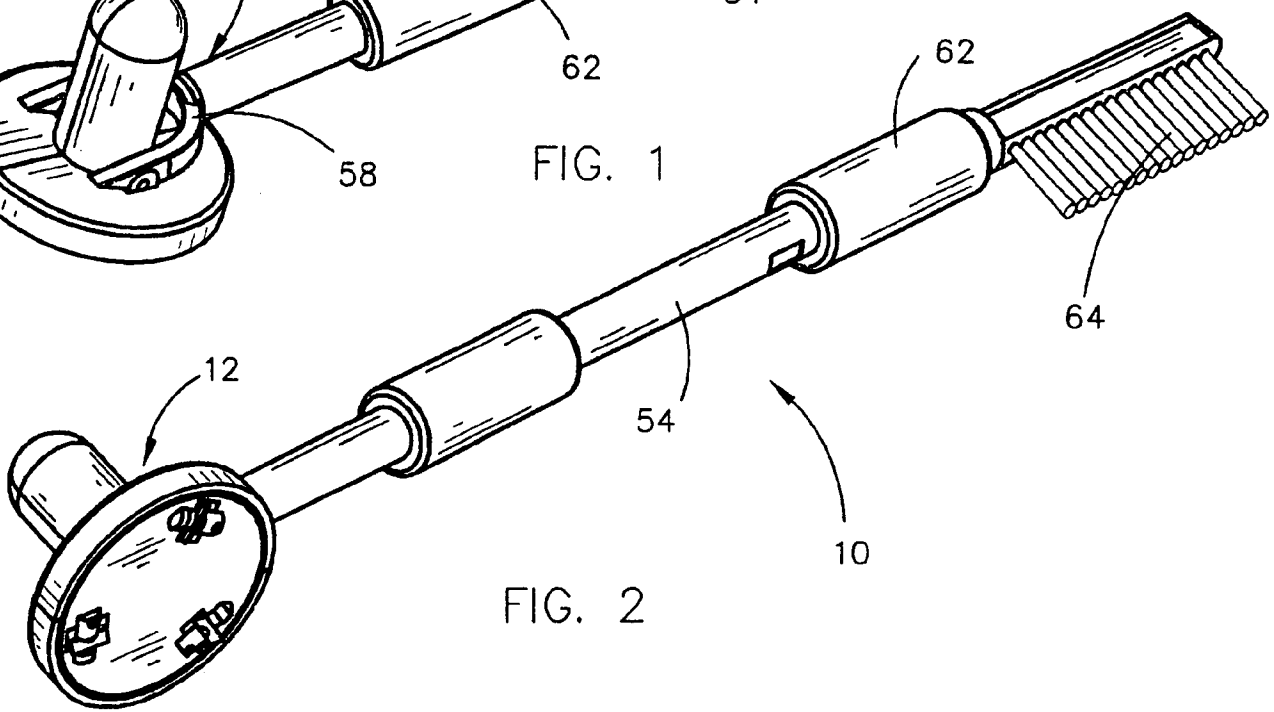
FIG. 2 depicts another perspective view of the debris removal tool of FIG. 1.

Embodiments are described more fully below with reference to the accompanying drawings, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

A debris removing tool 10 of the present invention is generally comprised of a head unit 12, having a base plate 14 and at least one cutting tooth 16 extending outwardly from a lower surface 18 of the base plate 14. A drive unit 20 is operatively coupled with the base plate 14 in a manner that permits the drive unit 20 to selectively rotate the base plate 14 about an axis extending generally normal to the base plate 14. In a preferred embodiment, the drive unit 20 is provided in the form of an electric motor. However, other types of powered motors and manual drive units are contemplated and may be used interchangeably.

Figure 4:
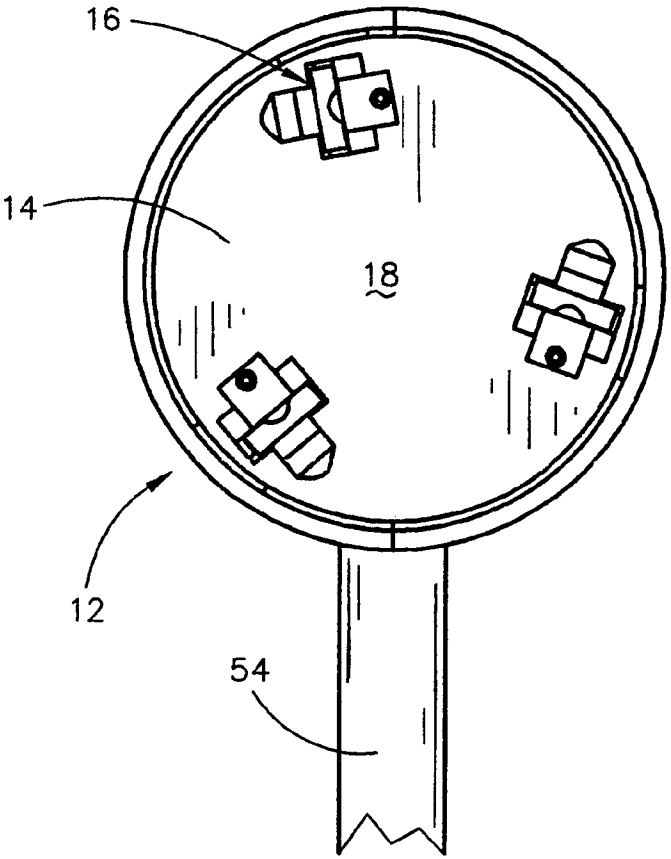
FIG. 4 depicts a bottom, plan view of the head unit depicted in FIG. 3.
Figure 3:
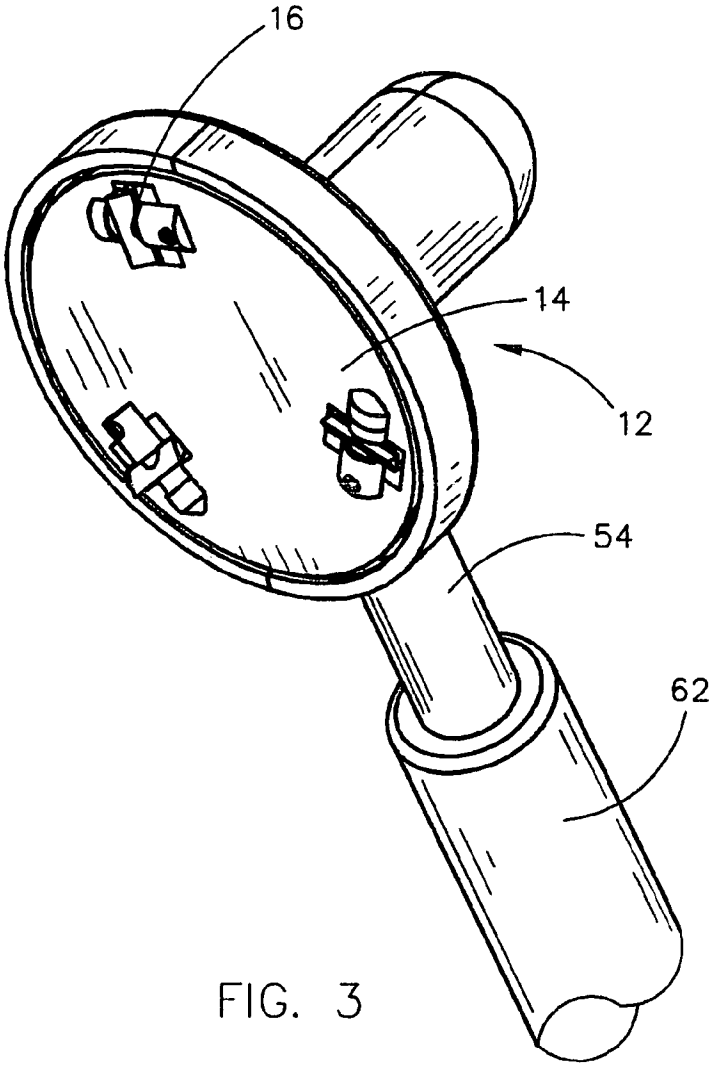
FIG. 3 depicts an isometric view of one embodiment of a head unit that may be used with the debris removal tool.
Figure 5:
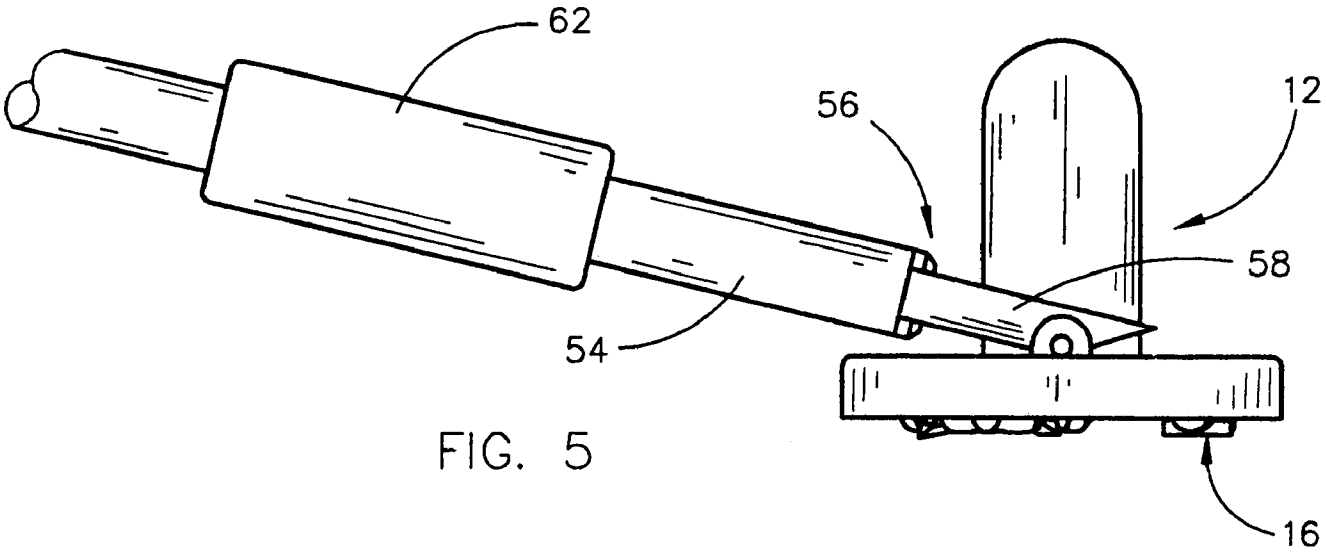
FIG. 5 depicts a side elevation view of the head unit depicted in FIG. 3.
Figure 6:
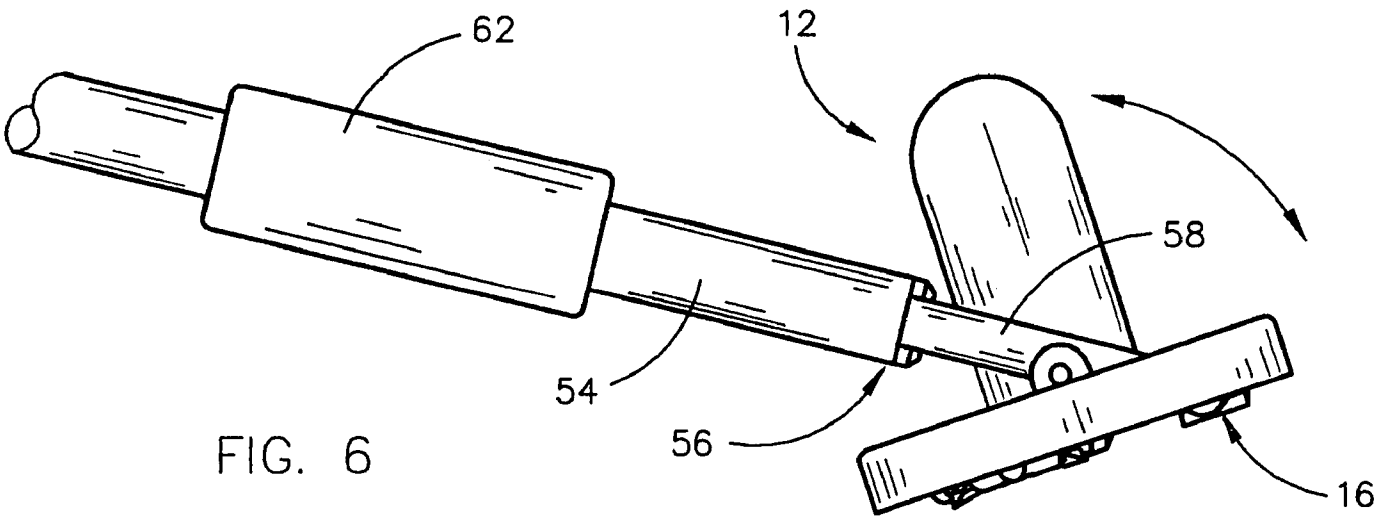
FIG. 6 depicts a side elevation view of the head unit depicted in FIG. 3 and further demonstrates one embodiment of pivotable movement between the head unit and a handle.
Figure 7:
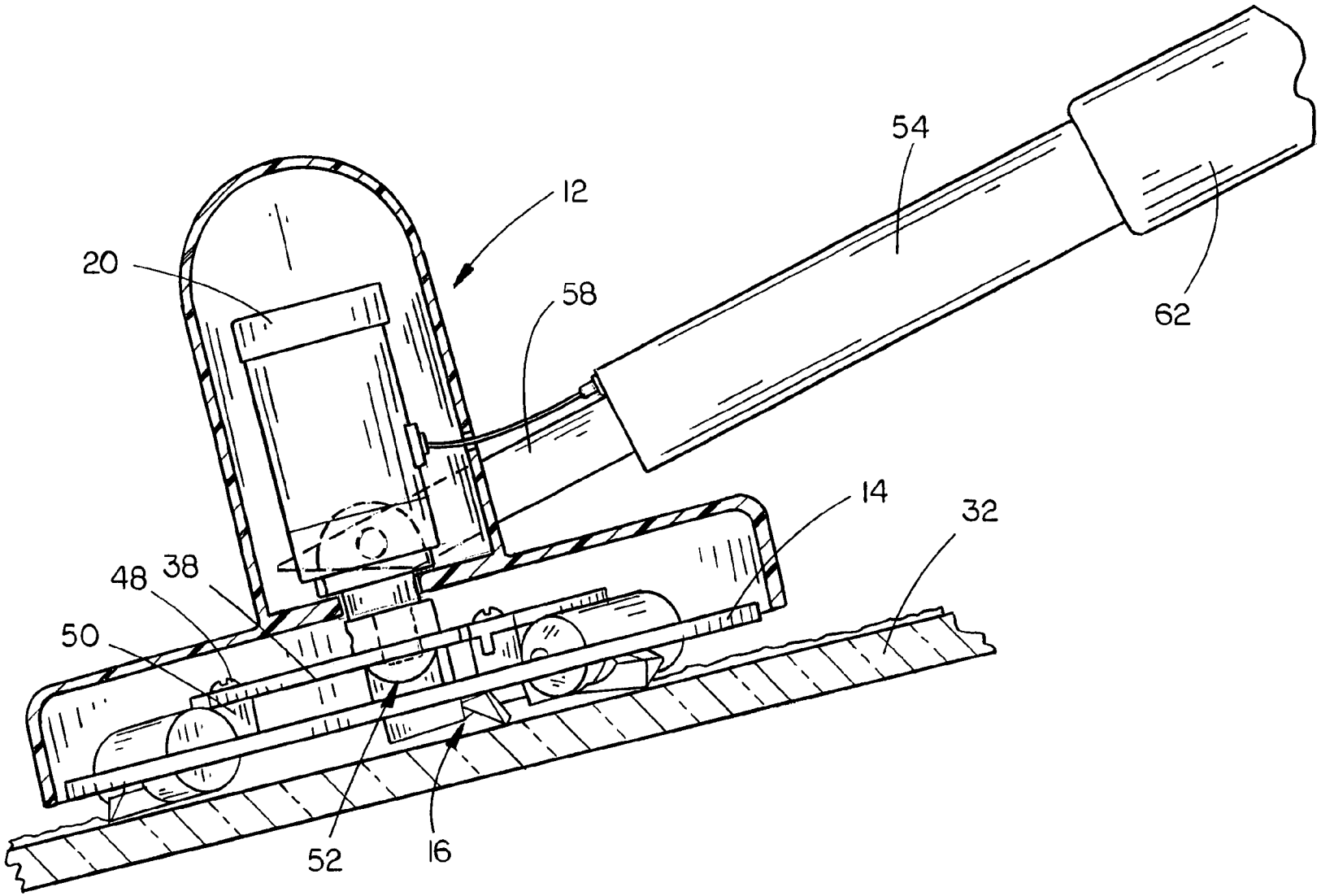
FIG. 7 depicts a partial, cut away view of one embodiment of a head unit that may be used with the debris removal tool and further demonstrates one possible method of use in removing debris from an operating surface.
Figure 9:
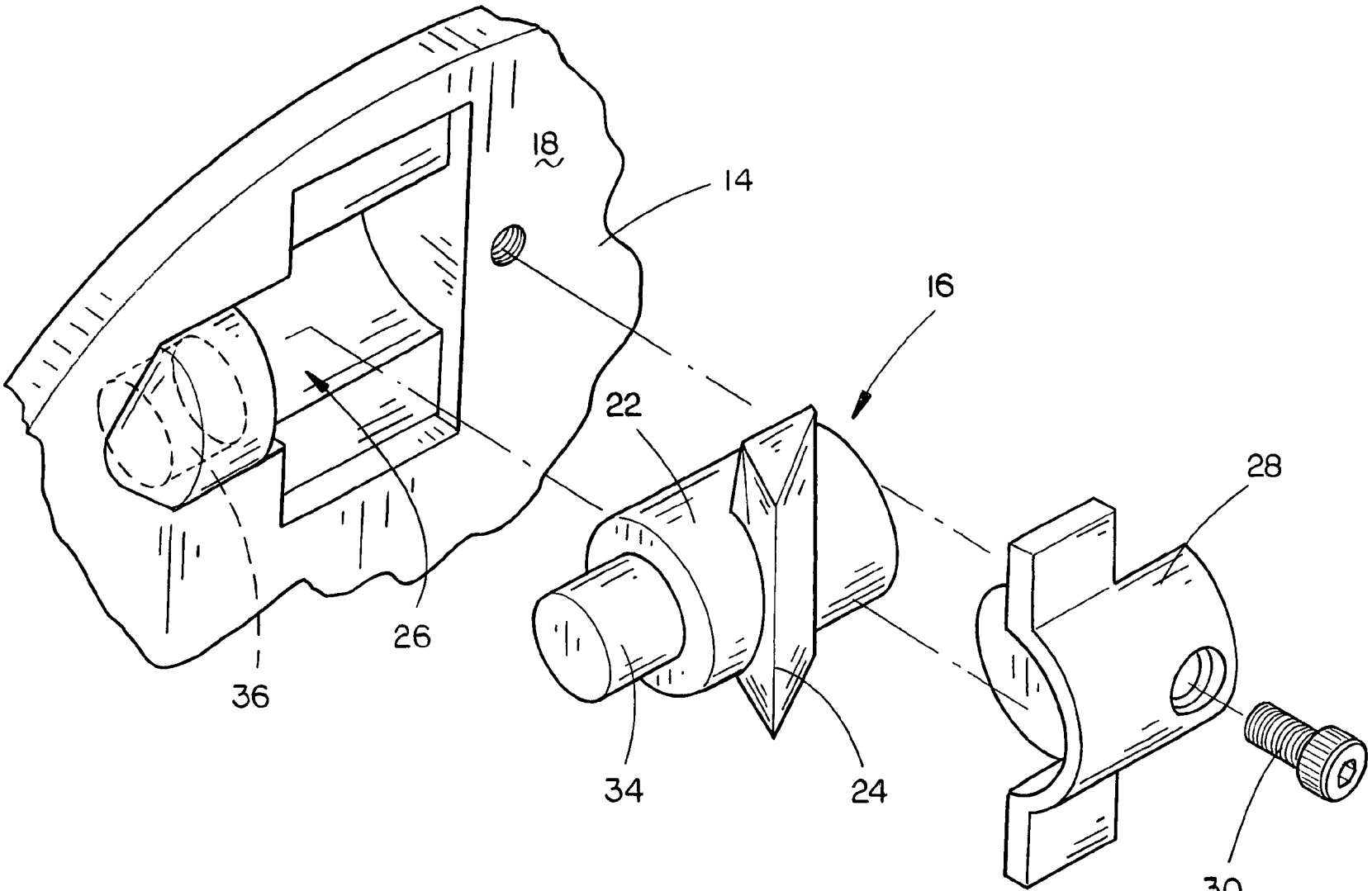
FIG. 9 depicts a partial, exploded view of a cutting tooth and one manner in which the cutting tooth may be removably engaged with a base plate of the debris removal tool.
Figure 10B:
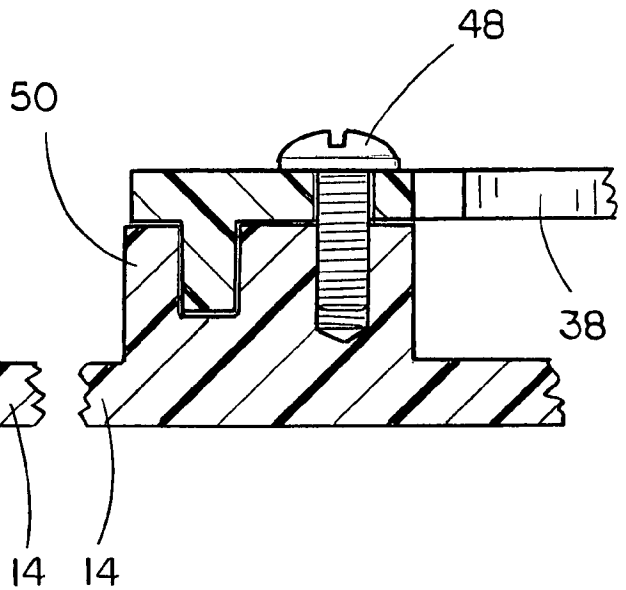
FIG. 10B depicts a cut away, elevation view of the flex plate and base plate depicted in FIG. 9.
Figure 10A:
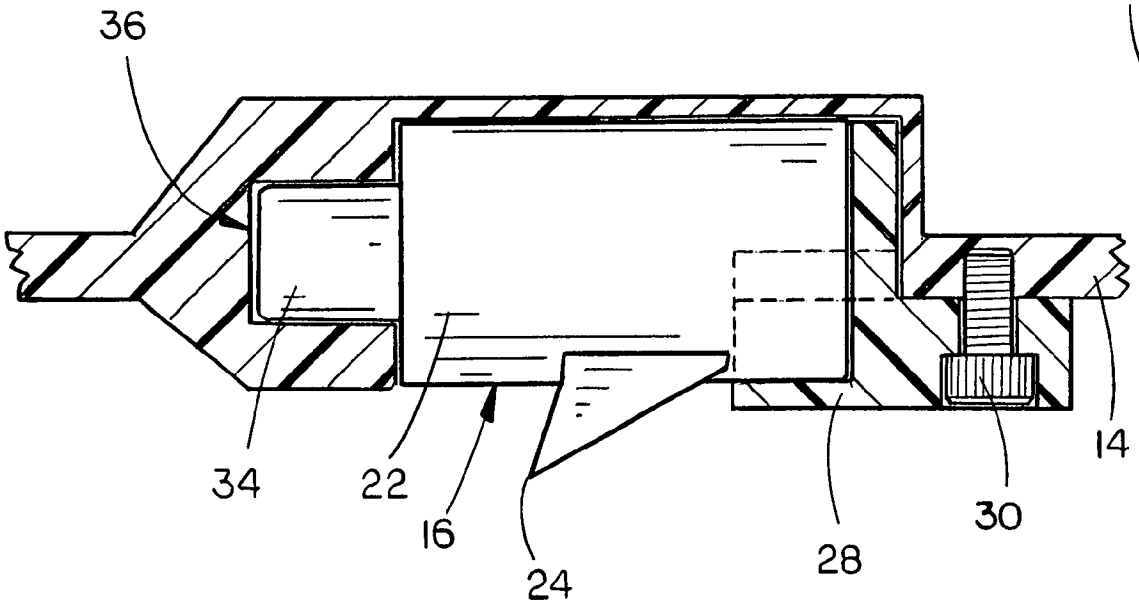
FIG. 10A depicts a cut away, elevation view of the cutting tooth and base plate depicted in FIG. 9.

While it is contemplated that one cutting tooth 16 may be used to operate the tool 10, a plurality of cutting teeth 16 are preferred. Due to the rotational nature of the base plate 14, the plurality of cutting teeth 16 may be arranged in a pattern similar to that depicted in FIG. 4. However, other patterns, including a staggered interrelationship between the cutting teeth 16 are contemplated. Irrespective of their location, it may be preferable to provide a removable engagement between the cutting teeth 16 and the base plate 14 in order to facilitate maintenance and versatility. To that end, the cutting teeth 16 may be shaped to have a mounting body 22, from which a cutting edge 24 extends. The mounting body 22 may be shaped and sized to be removably received by a recess 26 formed in the lower surface 18 of the base plate 14. A cap 28 may be provided to be releasably secured over at least a portion of the mounting body 22 in order to retain the tooth 16 within the recess 26. A set screw 30 or other such releasable fastener may be employed to secure the cap 28 in position.

Where the head unit 12 is provided with a plurality of cutting teeth 16 it may be preferably to pivotably mount the cutting teeth 16 to the base plate 14 to enable the teeth 16 to adapt to variable geometry presented by any operating surface 32. In one preferred embodiment, the cutting tooth 16 is pivotably moveable about an axis that extends generally perpendicular to a long axis of the cutting edge 24. To accommodate this movement, the mounting body 22 and the recess 26 may be shaped in size to provide generally curved mating surfaces. One example, depicted in FIG. 9, illustrates the mounting body 22 and the recess 26 to be generally cylindrical in nature. A pivot pin 34 may be provided to extend coaxially outwardly from a first end portion of the mounting body 22, such that it may be releasably received within a socket 36 formed within the recess. The pivot pin 34 and socket 36 should be shaped and positioned with respect to one another such that rotation is permitted between the two structures while preventing unwanted extraction of the cutting tooth 16 from the recess 26 when it is secured therein.

Figure 8:
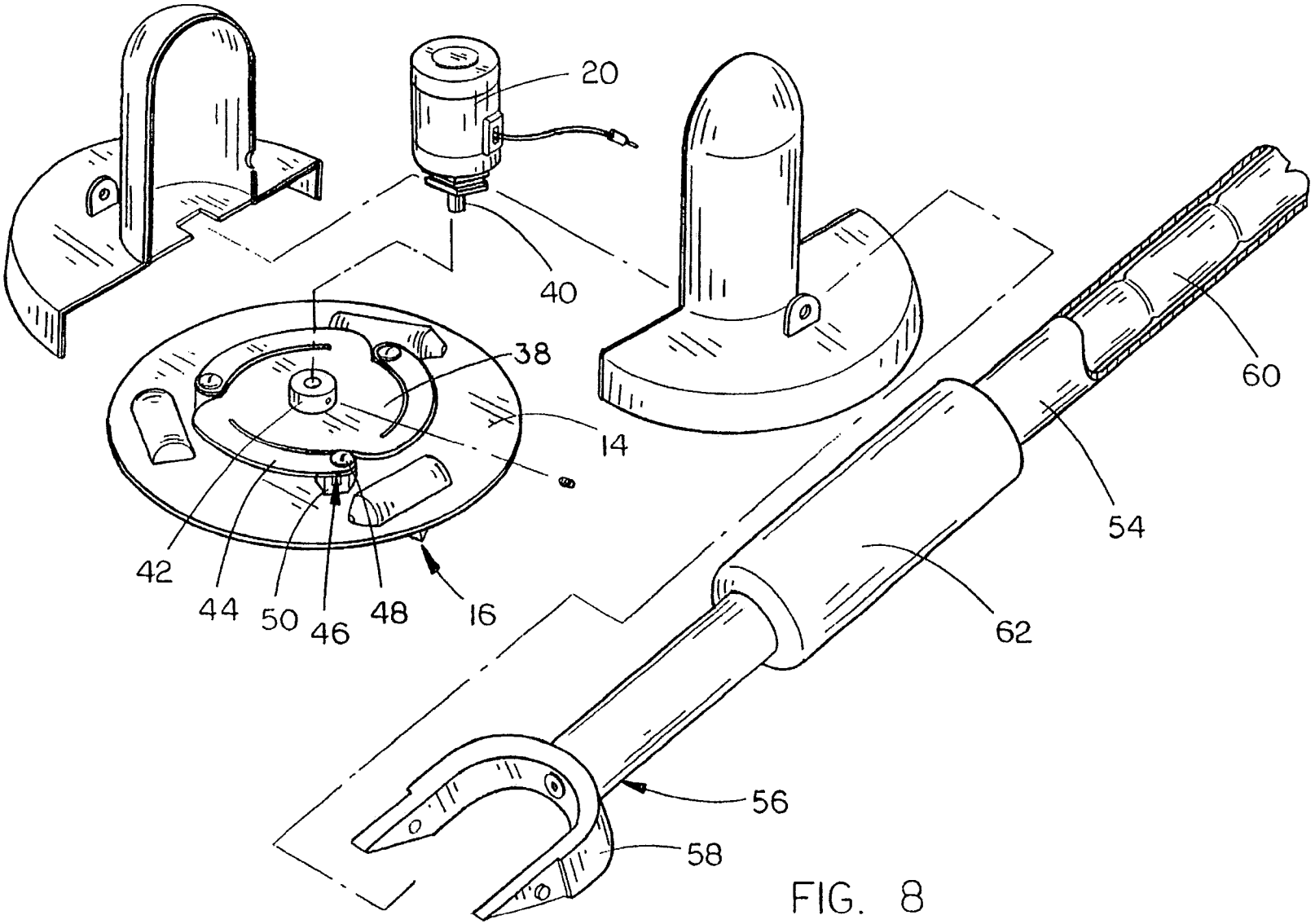
FIG. 8 depicts a partial, exploded view of one embodiment of the debris removal tool.

It may be desirable to provide greater adaptability to the head unit 12 when it is engaged with curved or irregularly shaped operating surfaces. Accordingly, one embodiment of the head unit 12 provides a flex plate 38 that is operatively coupled with the base plate 14 and the drive unit 20, such that the axis on which the base plate 14 rotates is permitted to swivel with respect to the drive unit 20. In one preferred embodiment, a drive shaft 40, associated with the drive unit 20, may be secured to a collar 42 associated with the flex plate 38. A plurality of fingers 44, such as those depicted in FIG. 8, may be formed into the flex plate 38. Distal end portions 46 of the fingers 44 may be operatively coupled with the base plate 14, using screws 48 or other known fasteners. Spacing blocks 50 may be provided to extend outwardly from the base plate 14 and receive tle distal end portions 46 of the fingers 44. In this manner, the base plate 14 and the flex plate 38 will be positioned in a partially, spaced-apart manner that permits the flex plate 38 to flex as the cutting teeth 16 engage an operating surface that is curved or irregularly shaped. The resiliently deformable nature of the fingers 44 may be varied according to the type of material used to fabricate the flex plate 38, such as various metals, plastics and the like. The thickness of the flex plate 38 will further dictate the level of rigidity or flexibility exhibited. However, the length and geometry of the fingers 44 will further determine the flexing characteristics of the flex plate 38. For example, the arcuately shaped fingers 44 depicted in FIG. 8, extend along the periphery of a central body portion of the flex plate 38. This permits the fingers 44 to have a relatively long length, while retaining the compact size of the flex plate 38. The number of fingers 44 used will further dictate the flexing characteristics of the flex plate 38 and may be selected according to the desired uses of the tool 10. The flex plate 38 may be stabilized by a curved bearing surface 52 that extends outwardly from a lower surface of the flex plate 38 to engage an upper surface of the base plate 14.

It is contemplated that an operator may need to position the head unit 12 a greater distance along the operating surface 32 than the operator's arm will allow, an elongated handle 54 may be operatively coupled at a first end portion 56 thereof with the head unit 12. In one preferred embodiment, the first end portion 56 may be provided with a forked mounting arm 58 that pivotably engages the head unit 12. In this manner, the head unit 12 may be selectively pivoted with respect to the handle 54 and permit various angles of usage by the operator. The handle 54 will also provide a convenient location to house a power source for the drive unit 20, such as a disposable or rechargeable battery 60. One or more resiliently deformable grips 62 may be positioned along the length of the handle 54 to increase the comfort level experienced by an operator. It is contemplated that the grip 62 may be comprised of nearly any suitable material, such as various open cell foams, and the like. To provide the tool 10 with additional functionality, a brush 64 may be disposed at a second end portion of the handle 54 to brush loose debris from the operating surface 32.

In use, an operator positions the debris removing tool closely adjacent the operating surface 32. The operator actuates the drive unit 20 so that the base plate 14 begins rotating. The operator may then simply move the debris removal tool adjacent the operating surface 32 so that the cutting teeth 16 engage the debris, as the base plate 14 and the cutting teeth 16 rotate, removing the debris from the operating surface 32. The rotating nature of the cutting teeth 16 will produce a broad, clear path through the debris. The various pivoting and/or flexing characteristics of the tool 10 will enable the tool 10 to clear debris from a wide range of operating surfaces with relative ease and efficiency.

Although the invention has been described in language that is specific to structural features and/or methodological steps, it is to be understood that the invention defined in the appended claims is not necessarily limited to the specific features or steps described. Rather, the specific features and steps are described as forms of implementing the claimed invention. Since many embodiments of the invention can be made without departing from the spirit and scope of the invention, the invention resides in the claims hereinafter appended.

What is claimed is:

1. A method of removing debris from an operating surface, the method comprising the steps of:

providing a debris removal tool, comprising a head unit having (i) a base plate, (ii) at least one cutting tooth pivotably coupled with and extending outwardly from a lower surface of said base plate, (iii) a drive unit operatively coupled with said base plate in a manner that permits said drive unit to selectively rotate said base plate about an axis extending generally normal to said base plate, and (iv) a flex plate that is operatively coupled with said base plate and said drive unit such that the axis on which said base plate rotates is permitted to swivel with respect to said drive unit;

positioning said debris removal tool closely adjacent the operating surface such that the at least one cutting tooth may engage debris on the operating surface;

actuating said drive unit so that said base plate begins rotating; and moving said debris removal tool closely adjacent the operating surface so that, as said base plate and said cutting tooth rotate, (i) the at least one cutting tooth engages the debris, and (ii) the at least one cutting tooth pivots with respect to said base plate and removes at least a portion of the debris from the operating surface.

2. The method of claim 1 further comprising:

providing said flex plate with a plurality of fingers, having distal end portions that are operatively coupled with said base plate; said fingers being formed to be resiliently deformable; and engaging debris with said debris removal tool whereby at least one of the plurality of fingers of said flex plate flexes.

3. A method of removing debris from an operating surface, the method comprising the steps of:

providing a debris removal tool, comprising a head unit (i) a base plate, (ii) at least one cutting tooth pivotably coupled with and extending outwardly from a lower surface of said base plate, and (iii) a drive unit operatively coupled with said base plate in a manner that permits said drive unit to selectively rotate said base plate about an axis extending generally normal to said base plate;

positioning said debris removal tool closely adjacent the operating surface such that the at least one cutting tooth may engage debris on the operating surface;

actuating said drive unit so that said base plate begins rotating; and moving said debris removal tool closely adjacent the operating surface so that, as said base plate and said cutting tooth rotate, the at least one cutting tooth engages the debris and pivots with respect to said base plate.

4. The method of claim 3 further comprising:

moving said debris removal tool whereby said at least one cutting tooth pivots about an axis that extends generally perpendicular to a long axis of a cutting edge on said at least one cutting tooth.

5. The method of claim 3 further comprising:

removably coupling said at least one cutting tooth with said base plate prior to the step of positioning said debris removal tool closely adjacent the operating surface.

6. The method of claim 3 further comprising:

coupling a flex plate with said base plate said drive unit such that the axis on which said base plate rotates is permitted to swivel with respect to said drive unit.

7. The method of claim 5 further comprising:

providing said at least one cutting tooth with a generally cylindrical mounting body that extends generally perpendicular to a long axis of a cutting edge on said at least one cutting tooth; and positioning said mounting body within a recess formed within said base plate.

8. The method of claim 7 further comprising:

positioning a pivot pin within a socket formed in said recess to extend coaxially outwardly from a first end portion of said mounting body.

9. The method of claim 8 further comprising:

releasably coupling a cap over a portion of said mounting body to retain said at least one tooth within said recess.

10. A method of removing debris from an operating surface, the method comprising the steps of:

providing a debris removal tool, comprising a head unit having (i) a base plate, (ii) at least one cutting tooth pivotably coupled with and extending outwardly from a lower surface of said base plate, (iii) a drive unit operatively coupled with said base plate in a manner that permits said drive unit to selectively rotate said base plate about an axis extending generally normal to said base plate, and (iv) an elongated handle, having a first end portion that is operatively coupled with said head unit and said drive unit;

positioning said debris removal tool closely adjacent the operating surface such that the at least one cutting tooth may engage debris on the operating surface;

actuating said drive unit so that said base plate begins rotating; and manipulating said handle whereby moving said debris removal tool closely adjacent the operating surface so that, as said base plate and said cutting tooth rotate, (i) the at least one cutting tooth engages the debris and (ii) the at least one cutting tooth pivots with respect to said base plate and removes at least a portion of the debris from the operating surface.

11. The method of claim 10 further comprising:

pivotably coupling the first end portion of said elongated handle with said head unit and said drive unit;

manipulating said handle whereby moving said debris removal tool closely adjacent the operating surface so that, as said handle is manipulated, the head unit pivots with respect to said handle.

* * * * *